United States Patent [19]

Cotroneo

[11] 4,307,817

[45] Dec. 29, 1981

[54] LID AND CONTAINER COMBINATION

[76] Inventor: George Cotroneo, R.R. 1, Alton, Ontario, Canada, L0N 1A0

[21] Appl. No.: 136,185

[22] Filed: Mar. 31, 1980

[51] Int. Cl.[3] ..... B65D 39/00

[52] U.S. Cl. ..... 220/307; 220/DIG. 19; 215/DIG. 1

[58] Field of Search ..... 220/306, 307, DIG. 19; 215/320, 355, DIG. 1

[56] References Cited

U.S. PATENT DOCUMENTS

| | | | |
|---|---|---|---|
| 1,980,364 | 11/1934 | Thomas | 220/306 X |
| 2,080,685 | 5/1937 | Ashe | 220/320 X |
| 2,778,525 | 1/1957 | Hermer | 220/306 |
| 2,913,140 | 11/1959 | Vuillemenot | 220/306 |
| 3,392,873 | 7/1968 | Old, Jr. | 220/306 |
| 3,485,436 | 12/1969 | Mirasol, Jr. | 220/307 |
| 3,556,338 | 1/1971 | Wilkinson | 220/306 |
| 3,805,994 | 4/1974 | Cherry et al. | 220/306 |
| 3,817,420 | 6/1974 | Heisler | 220/307 |
| 4,178,001 | 12/1979 | Stanley et al. | 277/152 |

FOREIGN PATENT DOCUMENTS

| | | |
|---|---|---|
| 976221 | 10/1950 | France . |
| 174552 | 3/1961 | Sweden . |

*Primary Examiner*—George T. Hall

*Attorney, Agent, or Firm*—Rogers, Bereskin & Parr

[57] ABSTRACT

The invention relates to a container and lid combination in which a flexible skirt is injection molded with either the container or lid to provide the combination with a seal. The skirt extends either radially inwardly from an inner container surface or radially outwardly from the underside of the lid, and is so shaped that as the lid is located about the container rim the skirt is deflected to a position in which it is biased because of the elasticity of the elastomeric material from which it is constructed to press against the inner container surface or underside of the lid in sealing engagment. In a preferred embodiment a circumferential bead is molded to one of the inner container surface and underside of the lid, and co-operates with the skirt to releasably secure the lid to the container.

14 Claims, 5 Drawing Figures

LID AND CONTAINER COMBINATION

The invention relates to a novel lid and container combination in which a flexible skirt is injection molded with either the container or lid to provide a seal for the combination.

There is today a great demand for plastic containers of generally cylindrical shape. Lids for closing such containers have commonly been constructed with flat, upper lid portions and generally cylindrical sidewalls shaped to grip container surfaces. Perhaps one of the most common ways of making a lid attachable to such a container is to mold a lip radially outwardly from the rim of the container for engagement with a groove provided in a radially inner surface of the lid sidewall. Such an arrangement provides positive gripping action, and an air-tight seal if properly dimensioned. A variety of alternative ways of making a lid attachable to such a container have been proposed or used, but these are too numerous to be fully discussed here. The invention affords a novel way of attaching a lid to and sealing a container.

The invention provides a container and lid combination in which the container has a sidewall defining a rim, an opening circumscribed by the rim, and an inner container surface adjacent to the rim. The lid is adapted to be located about the container rim, and includes a dished lid portion which extends into the opening in the container when the lid is located about the container rim. A flexible skirt is injection molded with one of the inner container surface and the dished lid portion of an elastomeric material, the skirt being so shaped that, as the lid is located about the container rim, the skirt is deflected to an operative position in which the skirt is biased because of the elasticity of the elastomeric material to press against the other one of the inner container surface and dished lid portion to seal the interior of the container. Securing means are attached to at least one of the container and the lid for releasably securing the lid to the container when the lid is located about the container rim.

The invention will be better understood with reference to drawings in which.

Figure 1:
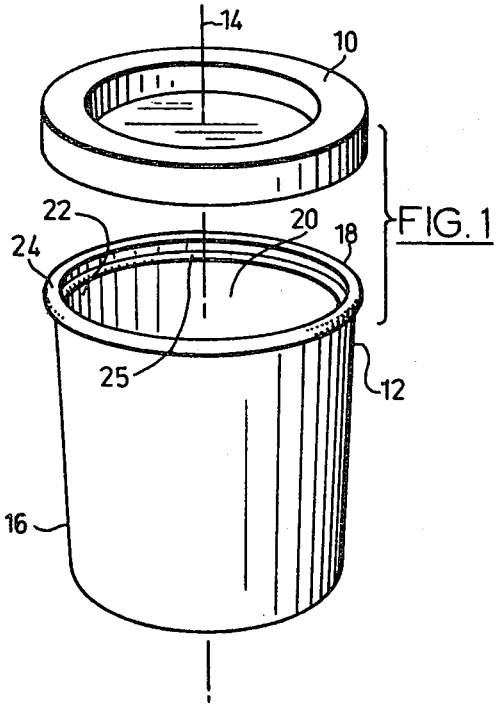
FIG. 1 is an exploded perspective view of a container and lid combination constructed according to the invention.

Reference is made to FIG. 1 which illustrates a lid 10 and a container 12 injection molded by conventional techniques from an elastomeric material such as polyethylene. The structure of the lid 10 and container 12 displays radial symmetry about an axis 14, and is better illustrated in the cross-sectional views of FIGS. 2 and 3.

The container 12 has essentially the same structure as any other conventional plastic container commonly used to contain food products. The container 12 has a vertical sidewall 16 of generally cylindrical shape, which defines at an upper end thereof a circular rim 18, an opening 20 circumscribed by the rim 18, and a substantially cylindrical inner container surface 22. The rim 18 is circumscribed by a radially outwardly extending lip 24 which serves to strengthen the rim 18. A continuous bead 26 is molded around the inner container surface 22 for use in securing the lid 10 to the container in a manner discussed more fully below.

The lid 10 includes an upper lid portion 26, a cylindrical lid sidewall 28 which extends downwardly therefrom, and a centrally located dished lid portion 30. The lid 10 is dimensioned to be located about the rim 18 with an annular sidewall 32 of the dished lid portion 30 located substantially parallel to the inner container surface 22 and slightly spaced-apart therefrom. More will be said below about the relative spacing of the inner container surface 22 and the annular sidewall 32.

The lid 10 includes a flexible skirt 34 having an annular base 36 that circumscribes the annular wall 32 (on the underside of a lid 10). The skirt 34 includes an annular skirt portion 38 which extends radially outwardly from the base 36. (The words "radially outwardly" are used in the sense that the skirt portion 38 is directed generally away from the axis 14, and should not be understood as requiring the skirt portion 38 additionally to be oriented in a plane perpendicular to the axis 14). The skirt 34 is molded in a first position (illustrated in FIG. 2) in which the skirt portion 38 is inclined downwardly from the base 36 at an angle which is preferrably just a few degrees below horizontal. The inventor has found that persons in the molding trade have considered the injection molding of such a skirt, located in the interior of a closed structure, as relatively unfeasible. The inventor has found that, if the skirt 34 is inclined downwardly from the annular wall 32, molding apparatus can be readily withdrawn from the lid 10 without damaging the skirt 34. The skirt 34 will deform elastically downwardly (and the lid sidewall 28 and annular sidewall 32 will deflect away from one another) to permit such a withdrawal of molding apparatus, and it is believed that such an elastic deformation is possible even where the skirt is inclined several degrees above horizontal. (It should be noted that an angle near horizontal is preferred to enhance the locking action provided by the skirt 34 when the lid 10 is fit about the container 12, which will be discussed in greater detail below.) To make the skirt 34 even more elastically deformable during molding, the skirt is preferably tapered as illustrated with the base 36 having a thickness, for example, of 0.011 inches and with the skirt portion 38 in such circumstances tapering down to, for example, 0.007 inches at its radially innermost extremity.

Figure 2:
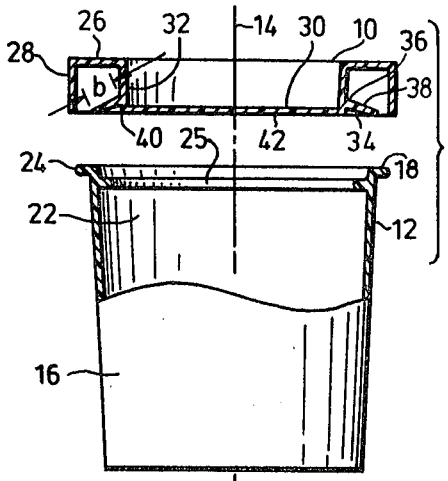
FIG. 2 is a side cross-sectional view of the lid and container in a vertical plane containing the axis of radial symmetry of the lid and container.
Figure 3:
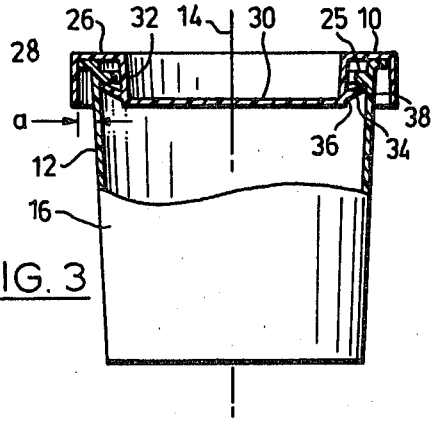
FIG. 3 is a side cross-sectional illustrating how the lid can be located on the container.

The manner in which the lid 10 is attached to the container 12 will now be described with reference to FIGS. 2 and 3. The lid 10 is pushed downwardly about the container rim 18 causing the skirt portion 38 to engage the container rim 18 and deflect upwardly towards the underside of the lid 10 relative to the annular sidewall 32. As the lid 10 is lowered further, the skirt 34 passes over and is deflected radially inwardly by the bead 25. The skirt 36 thereafter deflects radially outwardly to once again engage the inner container surface 22 in an operative position (illustrated in FIG. 3) in which the skirt 34 is biased because of the elasticity of the elastomeric material to press against the inner container surface 22 in sealing engagement. The radially outer skirt portion 38 now engages the underside of the bead 25 which acts as a stop to impede the removal of the lid 10 from the container 12 until sufficient upwardly-directed prying force is applied to the lid 10.

To obtain the desired seal the lid 10 and container 12 can be dimensioned as follows. A clearance "a" in the order of 0.020 inches can be provided between the inner container surface 22 and the annular sidewall 32. In such circumstances, the skirt 34 can have a width "b" in the order of 0.040 inches and the bead can have a thickness "c" in the order of 0.010 inches. (It will be appreciated that the dimensioning of portions of the lids and containers in FIGS. 1–5 have been exaggerated for the purposes of illustration, and do not purport to show a preferred dimensioning). It will be appreciated that an advantage of the lid and container combination 10, 12 of FIGS. 1–3 over the prior art device specifically described above is that the lid and container combination 10, 12 not only serves to provide a sealed compartment, but does so while remaining relatively non-sensitive to lack of uniformity in lid and container dimensioning. Variations in such relative dimensioning can be accommodated by the flexible skirt 32.

To facilitate the molding of the skirt 34 it is preferable to keep the skirt 34 as narrow as possible and consequently in the order of several tens of thousandths of an inch. The skirt 34 is preferrably molded at an annular line 40 where the annular wall 32 meets the bottom 42 of the dished lid portion 30. So located, the skirt 34 is more free to deflect radially inwardly when mold portions are withdrawn from the lid 10.

Figure 4:
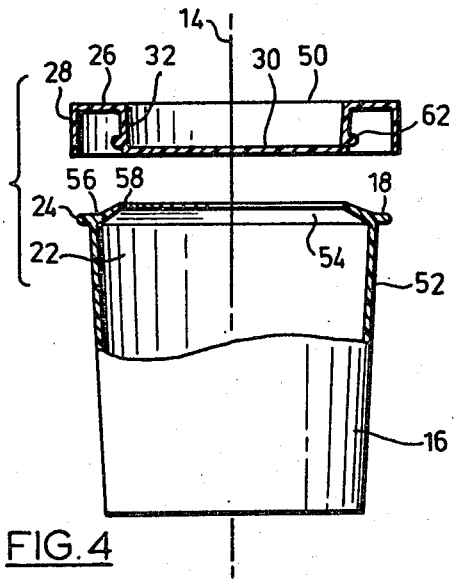
FIG. 4 is a side cross-sectional view illustrating another embodiment of the lid and container combination; and, FIG. 5 is a side cross-sectional view illustrating how the alternative embodiment of the lid and container can be assembled.
Figure 5:
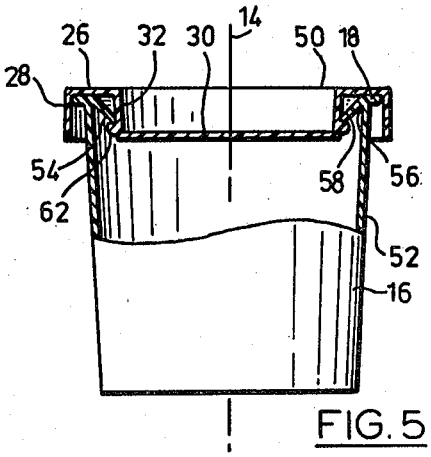

Reference is now made to FIGS. 4 and 5 which illustrate an alternative embodiment of a lid and container combination constructed according to the invention comprising a lid 50 and a container 52. The lid and container 50, 52 have substantially the same structure as the lid and container 10, 12, and consequently features common to the two embodiments of the invention have been indicated with like reference numerals. For a fuller description of such features, reference may be made to the description above.

The container 52 is injection molded with a flexible, circumferential skirt 54 having an annular base 56 that circumscribes the rim 18. The skirt 54 includes an annular skirt portion 58 which extends radially inwardly from the base 56. (The words "radially inwardly" are used in the sense that the skirt portion 58 is directed generally towards the axis 14, and should not be understood as requiring the skirt portion 38 additionally to be oriented in a plane perpendicular to the axis 14.) The skirt 54 is molded in a first position (illustrated in FIG. 4) in which the skirt portion 58 is inclined upwardly from the base 56 at an angle which is preferably a few degrees above horizontal, and as close to horizontal as possible. If the skirt 34 is inclined upwardly from the rim 18, molding apparatus can be readily withdrawn from the lid 50 without damaging the skirt 54. It is believed that such an elastic deformation is possible even where the skirt is inclined several degrees below horizontal. Although there is less likelihood of damaging the skirt 54 during molding if it inclined outwardly from the interior of the container 52, the skirt 54 is preferrably molded at an angle near horizontal to enhance the locking action provided by the skirt 54 when the lid 50 is fit on a container 52. (This will be discussed in greater detail below.) To further enhance the flexibility of the skirt 54, the skirt 54 is preferrably tapered in the same manner as the skirt 34 referred to above.

The lid 50 is not provided with an annular skirt as is its counterpart the lid 10. Instead, a circumferential bead 62 of generally semi-circular cross-section is molded with the annular wall 52 on the underside of the lid 50. It will be appreciated from what follows below that the bead 62 serves as a stop, in much the same manner as does the bead 25.

The manner in which the lid 50 is attached to the container 52 will now be described with reference to FIGS. 4 and 5. The lid 50 is pushed downwardly about the container rim 18 causing the annular wall 32 to deflect the skirt portion 58 downwardly towards the interior of the container 52. As the lid 50 is lowered further, the skirt 54 passes over and is deflected radially outwardly by the bead 60. The skirt 56 thereafter deflects radially inwardly to engage the annular wall 32 in an operative position (illustrated in FIG. 5) in which the skirt 54 is biased because of the elasticity of the elastomeric material to press against the annular wall 32 in sealing engagement. The radially inner skirt portion 58 now engages the top of the bead 62 which thereafter acts as a stop to impede the removal of the lid 50 from the container 52 until sufficient upwardly-directed prying force is applied to the lid 50.

To obtain the desired seal the lid 50 and the container 52 can be dimensioned by analogy to the lid 50 and container 52. Once again, the dimensioning of portions of the lid 50 and container 52 have been exaggerated for the purposes of illustration and do not proport to show any preferred dimensioning. It will be appreciated that the embodiment of FIGS. 4 and 5, like the embodiment of FIGS. 2 and 3, can tolerate some non-uniformity in lid and container dimensioning without losing the required seal, and without losing positive locking action between the lid and container.

It will be appreciated that by appropriate choice of elastomeric material and by appropriate shaping and dimensioning of the skirt, a lid and container combination constructed according to the invention can be provided with a seal which simply prevents the leakage of viscous liquid substances from the container or which is made effective enough to prevent the entry of air into the container, depending on the manufacturer's choice. The seal will be appropriately selected for the ultimate use to which the lid and container combination will be put.

The invention has been described with particular reference to substantially cylindrical containers and circular lids having generally radial symmetry. It is contemplated, however, the lids and containers constructed according to the invention can have a variety of shapes including, for example, rectangular and oval shapes. It will be appreciated by persons skilled in the art of molding plastics that, if a rectangular or similar shape is chosen for the lid and container, then the edges or corners of such a shape are preferably rounded to facilitate the molding of the circumferential skirt located either on the container or lid, and in particular to facilitate the withdrawal of mold portions without unduly damaging the skirt which will now reflect the shape of the rectangular or other straight-sided surface which it circumscribes. Furthermore, it is contemplated that the sealing skirt may be molded in the manner described above to either a lid or container without providing a bead or a similar stop on the corresponding member. In such circumstances, the skirt would provide only a sealing function, and need not be involved in the securing of the lid to the container. Consequently, any of a variety of techniques conventional or otherwise can be used in such circumstances to secure the lid to the container. For example, a projection could be molded to the radially inner surface of the lid sidewall for engagement with the underside of the container lip.

I claim:

1. A container and lid combination in which:

the container has a sidewall defining a rim, an opening circumscribed by the rim, and an inner container surface adjacent to the rim;

the lid is adapted to be located about the container rim, the lid including a dished lid portion which extends into the opening in the container when the lid is located about the container rim;

a flexible skirt is injection molded of an elastomeric material with one of the inner container surface and the dished lid portion, the skirt being so shaped that as the lid is located about the container rim the skirt is deflected relative to the one of the inner container surface and the dished lip portion by the other one of the inner container surface and the dished lid portion to an operative position in which the skirt is biased because of the elasticity of the elastomeric material to press against the other one of the inner container surface and the dished portion in sealing engagement thereby sealing the interior of the container; and securing means attached to at least one of the container and the lid for releasably securing the lid to the container when the lid is located about the container rim.

2. A combination as claimed in claim 1 in which the securing means comprise a stop, attached to the other one of the inner container surface and the dished lid portion, which the skirt passes over when the lid is located about the container rim and which thereafter engages the skirt when the skirt is in the operative position to impede the removal of the lid from the container.

3. A combination as claimed in claim 2 in which the stop comprises a bead extending from and circumscribing one of the inner container surface and the dished lid portion.

4. A combination as claimed in claims 1, 2 or 3 in which the container sidewall is generally cylindrical in shape and the skirt has a generally annular shape.

5. A container and lid combination in which:

the container is injection molded and has a container sidewall which defines a rim, an opening circumscribed by the rim, and a inner container surface adjacent to the rim;

a lid adapted to be located about the container rim, the lid including a dished lid portion which extends into the opening in the container when the lid is located about the container rim;

a flexible skirt is injection molded with the container, the skirt extending radially inwardly from and circumscribing the inner container surface, the skirt being so shaped that, as the lid is located about the container rim, the skirt is deflected relative to the inner container surface by the dished lid portion towards the interior of the container to an operative position in which the skirt is biased because of the elasticity of the elastomeric material to press against the dished portion in sealing engagement, thereby sealing the interior of the container; and, securing means attached to at least one of the container and lid for releasably securing the lid to the container when the lid is located about the container rim.

6. A combination as claimed in claim 5 in which the securing means comprise a stop, attached to the dished portion, the dished portion which the skirt passes over as the lid is located about the container rim and which thereafter engages the skirt when the skirt is in the operative position to impede the removal of the lid from the container.

7. A combination as claimed in claim 5 in which the securing means comprise a stop so positioned on the underside of the dished lid portion that, as the lid is located about the container rim, the stop deflects at least a portion of the skirt radially outwardly and then clears the skirt to enter the interior of the container whereupon the skirt locates against the dished portion in the operative position, whereby the stop is positioned relative to the skirt to impede the removal of the lid from the container.

8. A combination as claimed in claim 6 or 7 in which the stop comprises a bead which circumscribes the underside of the dished lid portion.

9. A combination as claimed in claims 5, 6 or 7 in which the container sidewall is generally cylindrical in shape and the skirt has a generally annular shape.

10. A container and lid combination in which:

the container has a container sidewall defining a rim, an opening circumscribed by the rim, and an inner container surface adjacent to the rim;

the lid is injection molded of an elastomeric material and adapted to be located about the container rim, the lid including a dished lid portion which extends into the opening in the container when the lid is located about the container rim and a flexible, circumferential skirt extending radially outwardly from the underside of the dished lid portion, the skirt being so shaped that, as the lid is located about the container rim, the skirt is deflected by the inner container surface towards the underside of the lid to an operative position in which the skirt is biased because of the elasticity of the elastomeric material to press against the inner container surface in sealing engagement, thereby sealing the interior of the housing; and, securing means attached to at least one of the container and lid for releasably securing the lid to the container when the lid is located about the container rim.

11. A combination as claimed in claim 10 in which the securing means comprise a stop attached to the inner container surface which the skirt passes over as the lid is fit about the container when the lid is located about the container rim and which thereafter engages the skirt when the skirt is located in the operative position to impede the removal of the lid from the container.

12. A combination as claimed in claim 10 in which the securing means comprise a stop as positioned on the inner container surface that, as the lid is located about the container rim, the skirt is deflected radially inwardly as the skirt passes over the stop and then deflects radially outwardly to engage the inner container surface in the operative position, whereby the stop is positioned to impede the removal of the lid from the container.

13. A combination as claimed in claim 6 or 7 which the stop comprises a bead which circumscribes the inner container surface.

14. A combination as claimed in claims 10, 11 or 12 in which the container sidewall is generally cylindrical in shape and the skirt has a generally annular shape.

* * * * *